US010821450B2

(12) United States Patent
Collinson et al.

(10) Patent No.: US 10,821,450 B2
(45) Date of Patent: Nov. 3, 2020

(54) MODIFIED SPRAY HEAD

(71) Applicant: Reckitt Benckiser (Brands) Limited, Slough (GB)

(72) Inventors: Nikki Collinson, Hull (GB); Avijit Das, Hull (GB); Scott Rudkin, Hull (GB); Anne Renée Jeanne Szklarz, Hull (GB); Christopher Witty, Hull (GB)

(73) Assignee: Reckitt Benckiser (Brands) Limited, Slough (GB)

( * ) Notice: Subject to any disclaimer, the term of this patent is extended or adjusted under 35 U.S.C. 154(b) by 0 days.

(21) Appl. No.: 15/752,524

(22) PCT Filed: Sep. 19, 2016

(86) PCT No.: PCT/GB2016/052918
§ 371 (c)(1),
(2) Date: Feb. 13, 2018

(87) PCT Pub. No.: WO2017/046616
PCT Pub. Date: Mar. 23, 2017

(65) Prior Publication Data

US 2018/0229248 A1 Aug. 16, 2018

(30) Foreign Application Priority Data

Sep. 18, 2015 (GB) ..... 1516547.5

(51) Int. Cl.
*B05B 12/28* (2018.01)
*B05B 15/50* (2018.01)
(Continued)

(52) U.S. Cl.
CPC ..... *B05B 1/28* (2013.01); *B05B 15/50* (2018.02); *B65D 83/28* (2013.01);
(Continued)

(58) Field of Classification Search
CPC ..... B05B 1/28; B05B 15/50; B05B 11/3052; B05B 11/3057; B05B 14/00; B65D 83/28; B65D 83/26
(Continued)

(56) References Cited

U.S. PATENT DOCUMENTS 3,515,348 A * 6/1970 Coffman, Jr. ..... B05B 1/28 239/103
4,107,043 A 8/1978 McKinney
(Continued)

FOREIGN PATENT DOCUMENTS

DE 3934740 A1 4/1991
EP 0887113 A1 12/1998
(Continued)

OTHER PUBLICATIONS

International Search Report and Written Opinion of the International Searching Authority for corresponding application PCT/GB2016/052918 dated Dec. 12, 2016.
(Continued)

*Primary Examiner* — Christopher S Kim
(74) *Attorney, Agent, or Firm* — Norris McLaughlin PA

(57) ABSTRACT

The invention relates to a modified spray head suitable for use with an aerosol composition.

16 Claims, 8 Drawing Sheets

(51) Int. Cl.

| | |
|---|---|
| ***B65D 83/28*** | (2006.01) |
| ***B05B 1/28*** | (2006.01) |
| *B65D 83/26* | (2006.01) |
| *B05B 11/00* | (2006.01) |

(52) U.S. Cl.
CPC ..... *B05B 11/3052* (2013.01); *B05B 11/3057* (2013.01); *B65D 83/26* (2013.01)

(58) Field of Classification Search
USPC ..... 239/120–122
See application file for complete search history.

(56) References Cited

U.S. PATENT DOCUMENTS

| | | | | |
|---|---|---|---|---|
| 4,883,227 | A | 11/1989 | Maas | |
| 2007/0051754 | A1 | 3/2007 | Strand et al. | |
| 2009/0321381 | A1 | 12/2009 | Paas et al. | |
| 2014/0263741 | A1* | 9/2014 | Deutsch | B05B 14/00 239/337 |

FOREIGN PATENT DOCUMENTS

| | | | |
|---|---|---|---|
| FR | 2330943 | A1 | 6/1977 |
| GB | 0237696 | A2 | 9/1987 |
| JP | H0316664 | A1 | 1/1991 |
| JP | 2013240445 | A | 12/2013 |
| WO | 2014006411 | A1 | 1/2014 |

OTHER PUBLICATIONS

GB Search Report for corresponding application GB1516547.5 dated Feb. 11, 2016.

* cited by examiner

MODIFIED SPRAY HEAD

FIELD OF INVENTION

The present invention relates to a modified spray head (or outlet head) suitable for a device for spraying a fluid and particularly but not exclusively, to a device for spraying fluids such as fragrances, deodorising fluids and/or pest control fluids and the like. The spray head is particularly adapted for used with aqueous compressed air aerosol formulations.

BACKGROUND

Prior art devices for spraying fragrances, and/or deodorising agents and/or sanitising fluids into a room consist of a mechanically actuated arm which is periodically activated to press down on a spray head secured to an aerosol canister containing the material to be sprayed.

The prior art devices are typically constructed as follows. An outer casing has an opening through which the spray is ejected. The casing has a removable section which is removed to allow a refill canister containing the spray material to be placed in the casing. A moulded spray head, as shown in FIG. 1 is placed over the outlet stalk of an aerosol spray can. The spray head has an inlet section having an opening to be placed over the outlet stalk of the aerosol canister. The actuation arm is located over the spray head and is caused periodically to press against the spray head to cause material from the aerosol can to be ejected through the spray head out of the opening in the casing and into the surroundings. The actuator arm is either battery powered or mains powered and can be set to activate at various time intervals which, for example, may be to activate every seven minutes, every fifteen minutes or every thirty minutes, whichever is set by a user.

The devices may allow the user complete control over the timing interval of activations. Alternative the device may allow the user choice between preset timings, with a high, medium and low frequency of spray for example.

A commercial example of such a device is the Air Wick Freshmatic® device.

A problem associated with the use of these devices is the dripping of excess formulation from the spray head. This problem is exacerbated by the increasing amount of aqueous based formulations used and by the use of compressed air aerosol formulations. Aqueous solutions are harder to evaporate than most organic solvent solutions and compressed air propellants do not provide the break-up force that drives complete vapourisation that LPG (liquid petroleum gas)propellant aerosol formulations benefit from.

Environmental, regulatory and cost concerns are driving the increase in aqueous/compressed gas aerosol products. Despite their inherent drawbacks. One of which is increased droplet build-up on the end of the spray head.

These droplets may combine and build up in time to form drops big enough to drip from the spray head. This can cause staining on the surface supporting the device.

It is an objective of the present invention to attempt to overcome these problems.

STATEMENTS OF INVENTION

In a first aspect the present invention comprises an outlet head for a spray device, the outlet head comprising: an inlet section having an opening adapted to receive an output section of a spray material container, the opening forming a first end of a fluid channel (inlet) for receiving spray material from the spray material container;

an outlet section including an end-cap adapted to eject spray material and forming a second end of the fluid channel (outlet) for ejecting spray material into the air;

wherein the outlet section is angled to eject the spray material at least 5 degrees above the horizontal plane; and wherein a droplet rib is positioned directly below the outlet section and runs from the end-cap towards the first end of the outlet head; such that droplets forming on the end cap are drawn down the droplet rib towards the inlet section.

In a further aspect the outlet section is angled between 5 and 45 degrees above the horizontal plane.

In a further aspect the outlet section is angled between 7 and 25 degrees above the horizontal plane.

In a further aspect the outlet section is angled between 9 and 15 degrees above the horizontal plane.

In a further aspect the front face of the end cap is planar perpendicular to the second end of the fluid channel and wherein the second end of the fluid channel is located at the centre of the front face.

In a further aspect the front face of the end-cap is convex in profile and wherein the second end of the fluid channel is located at the most raised section of the convex In a further aspect the end-cap comprises grooves in its surface adjacent the second end of the fluid channel, wherein the grooves provide a wicking effect to liquids remaining on the end-cap.

In a further aspect the grooves form a symmetric pattern around the second end of the fluid channel.

In a further aspect the end cap further comprises ridges that may slow or trap liquid droplets building up on the end-cap.

In a further aspect the droplet rib has a constant width and depth along its length.

In a further aspect the droplet rib has an increasing height along its length from end cap to inlet section, such that the angle of its bottom surface to the horizontal is greater than that of the outlet section.

In a further aspect the angle of the bottom surface of the droplet rib to the horizontal is between 3 and 25 degrees greater than that of the outlet section.

In a further aspect the outlet head is designed for use with a trigger spray aerosol device.

In a further aspect the outlet head is designed for use with an automatic aerosol spray device.

In a further aspect the outlet head is an actuator designed for use with a compressed air aerosol formulations.

DETAILED DESCRIPTION OF THE INVENTION

Aerosol formulations are widely used to disperse active ingredients into the air or surface to be treated.

Figure 1:
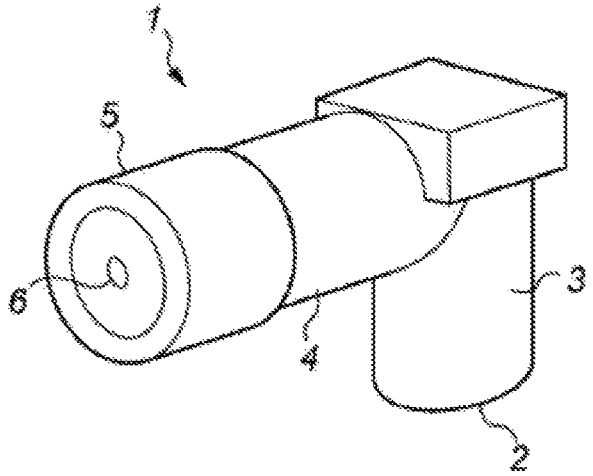
Figure 1 (Prior Art)
FIG. 1 illustrates a spray head of the art. Particularly one designed for use with an aerosol container and further particularly designed for use in an automatic aerosol dispenser device, such as Air Wicks Freshmatic® device.
Figure 2:
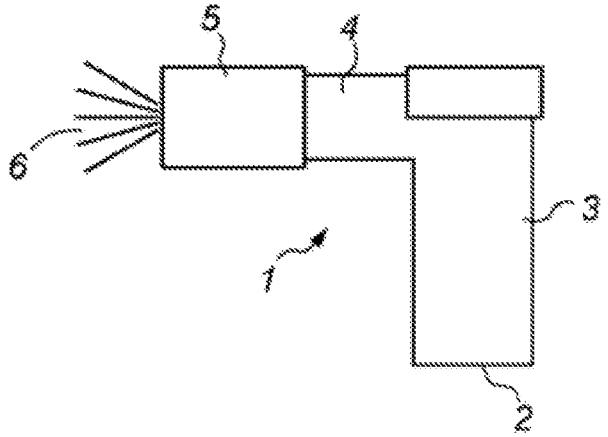
Figure 2 (Prior Art)
FIG. 2 shows a profile view of the spray head of FIG. 1.

FIGS. 1 and 2 show a well-known type of spray head used for an aerosol formulations delivered by automatic dispensing devices. For example, the well-known FreshMatic® devices from Air Wick.

For the purposes of the present invention the terms spray head, outlet head and actuator may be considered to be interchangeable. The actuators may have further internal technical features desirable for good spray performance.

The valve stem for the aerosol canister can be inserted into opening (inlet) 2. The fluid channel passes through the spray head to emerge at opening (outlet) 6. The fluid generally exits the spray head at right angles to the valve stem and this is usually in a horizontal direction as the aerosol canisters are inserted vertically into the automatic dispensing devices.

These prior art spray heads work very efficiently with normal aerosol formulations that utilise liquefied gaseous propellants, such as butane. These formulations disperse very readily into the air due to the vaporisation of the liquefied propellants and leave little trace or residues.

The use of liquefied gas propellants is increasingly undesirable, both in economic and environmental terms. There is an increasing drive to replace these formulations with compressed air aerosol formulations.

However the switch is not without significant technical challenge, requiring modifications not only to the formulations themselves but to the valves and actuators (spray heads) to compensate for the different pressures and modes of action. (The compressed air is not in the formulation to be dispensed but contained within a bag in the canister.)

Without the liquefied gas propellants the applicants have found that the aerosol compositions are not as readily dispersed and form much bigger particle/droplet sizes.

Over time and multiple sprays this can build up liquid on the spray heads. This then forms droplets that can fall from the spray head onto the surface the devices are standing on.

These droplets can cause staining to those surfaces as particularly fragrance compositions can comprise aggressive chemical components.

Figure 3:
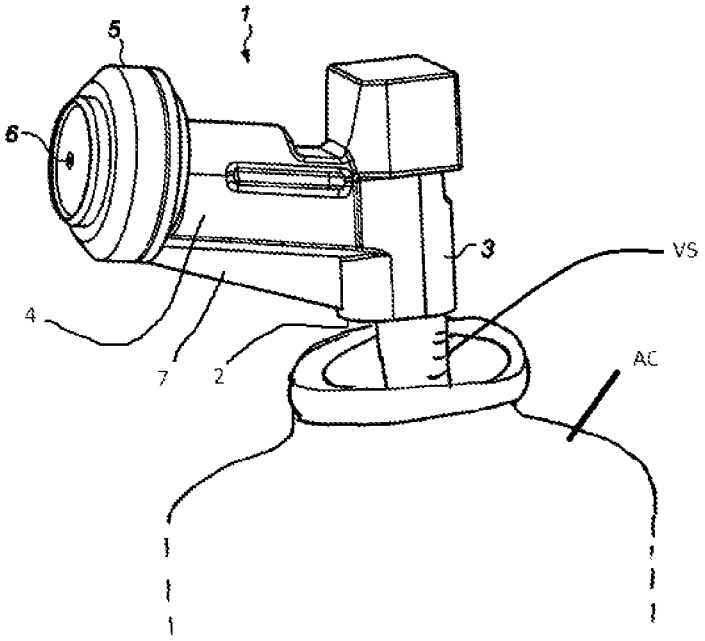
FIG. 3 illustrates a spray head of the present invention

FIG. 3 illustrates a spray head of the present invention which is designed to over-come this problem.

The key features of the inventive spray heads are the angle of the outlet section 4 in relation to the horizontal and the presence of a droplet rib 7 beneath the outlet section.

Prior art spray heads are normally right-angular in shape with the exit of the spray material in the horizontal plane, the inlet from the aerosol can in the vertical plane as the aerosol cans are normally stored vertically.

The inventive spray head or actuator is still designed to connect with a valve stem VS of an aerosol canister AC at inlet 2. However the outlet section 4 is raised such that it inclines at least 5 degrees above the horizontal plane. Preferably the outlet section inclines between 5 and 45 degrees above the horizontal plane, more preferably between 7 and 25 degrees above the horizontal plane and most preferably between 9 and 15 degrees above the horizontal plane.

Preferably the angle between the inlet and outlet portions of the spray head is between 95 and 135 degrees, more preferably between 97 and 115 degrees and most preferably between 99 and 105 degrees.

Figure 4:
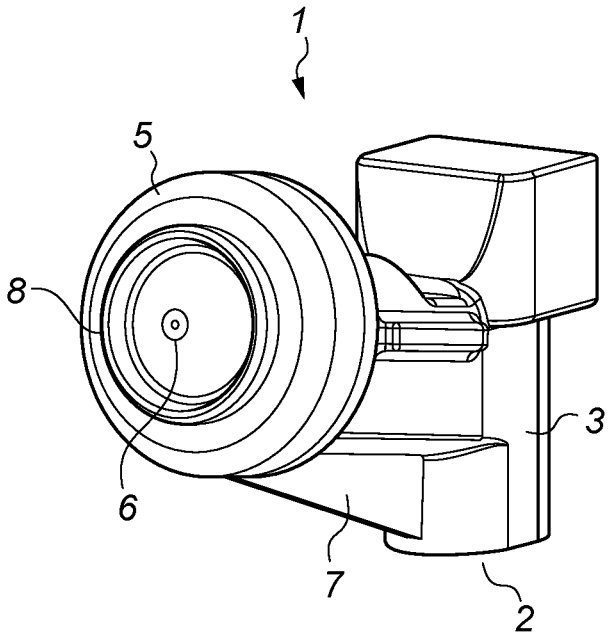
FIG. 4 illustrates an alternative view of the spray head depicted in FIG. 3.

FIG. 4 shows an alternative view of the spray head of FIG. 3.

The droplet rib 7 is located underneath outlet section 4 and engages with end-cap 5 to the extent required to wick any liquid droplets forming on the end cap away from the end cap and towards the valve stem of the can.

The rib may extend the entire length of the outlet section. This is the preferred embodiment. However the rib may only extend along a portion of the length of the outlet section.

The droplet rib may be between 0.1 and 3 mm wide. Preferably between 0.2 and 2 mm wide and most preferably between 0.25 and 1 mm wide. The width of the rib is measured in the horizontal plane.

Figure 5:
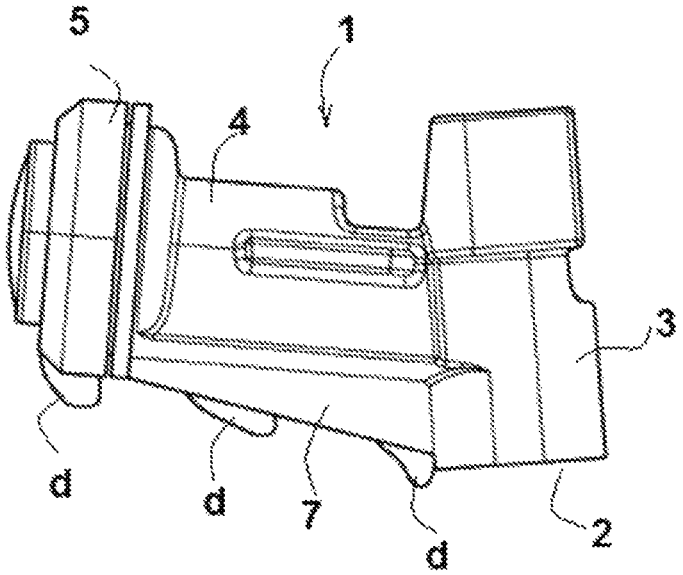
FIG. 5 illustrates the wicking effect of the droplet rib.

The increased angle over the horizontal plane of the outlet section provides gradient for the droplets to use. This gradient favours the wicking action of the droplet down the droplet rib over dripping directly downwards from the lowest point of the end-cap. The action of the droplets (d) can be seen in FIG. 5. This causes the droplets that form on the end-cap to run onto the can itself before evaporating. As the aerosol cans are replaced regularly, this causes less harm than if droplets were regularly falling on a table, cloth or carpet, for example.

The rib may have a constant height over the course of its length from end-cap to inlet section. The height of the rib is measured in the vertical plane.

Preferably the droplet rib has a height between 0.1 and 15 mm, more preferably the droplet rib has a height between 1 and 10 mm, most preferable between 1.5 and 7 mm.

In a further embodiment the rib height increases along its length, with a shorter height at the end-cap end than that at the inlet end.

The rib 7 may also be made from a more hydrophilic material than the body of the outlet head 1. Or it may be made of the same material but have been surface treated to increase its hydrophilic properties.

This is a preferred embodiment as it increases the effective gradient for the droplet to travel down over that offered by the outlet section alone.

The present invention is not limited by the size and shape of end-cap 5 used on the spray head. Any shape or profile of end-cap will work.

Particularly preferred shapes are round and either flat or convex profiles.

Figure 6:
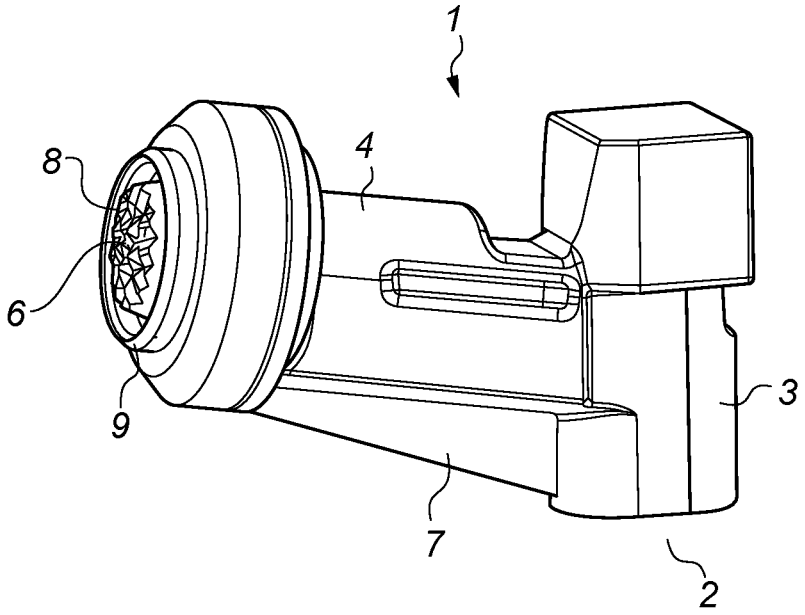
FIG. 6 illustrates an alternative embodiment of the present invention wherein the end cap further comprises grooves to help wick away excess liquid.

In another particularly preferred embodiment as shown on FIG. 6, the end cap may comprise grooves 8 adjacent the second end of fluid channel 6. These grooves 8 are designed to wick fluids remaining on the surface of the end-cap 5 post spray.

The grooves 8 help to evaporate this excess fluid prior to droplet formation.

The grooves 8 may be between 0.1 and 3 mm deep on the surface of the end-cap 5. Preferably the grooves are between 0.1 and 2 mm deep, more preferably between 0.2 and 1.5 mm deep and most preferably between 0.3 mm and 1 mm deep.

Figure 7:
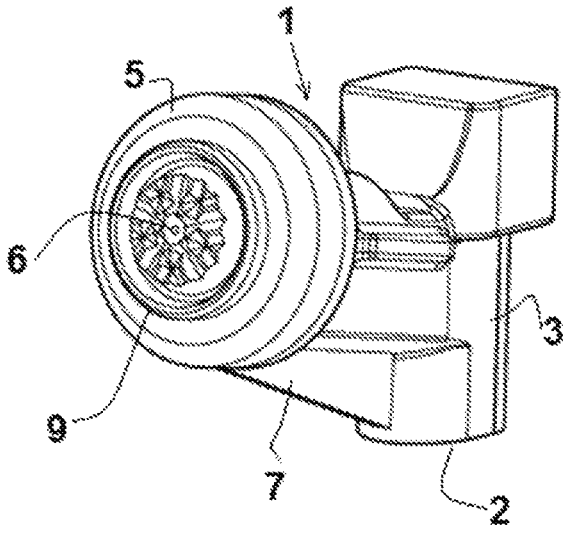
FIG. 7 illustrates an alternative view of the spray head of FIG. 6.
Figure 9:
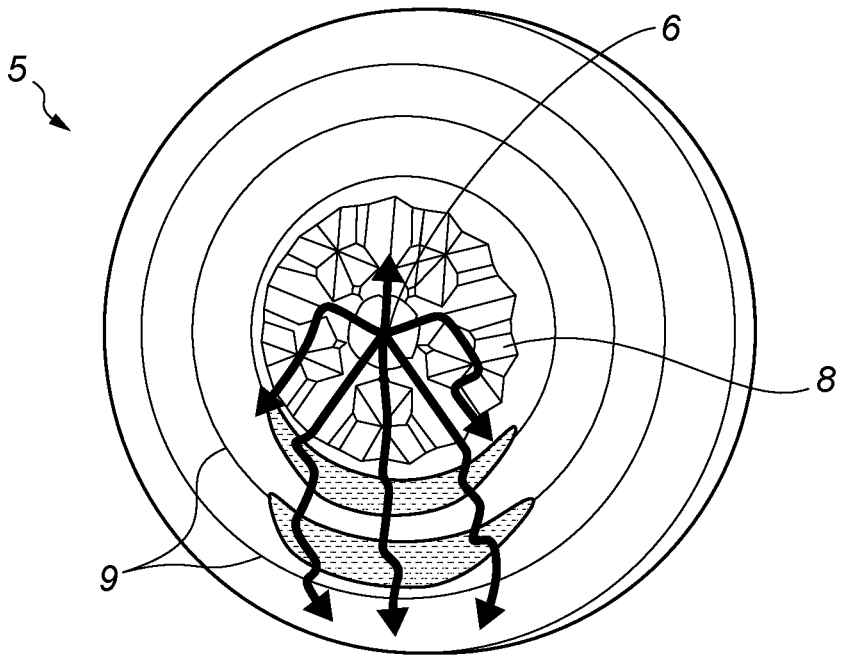
FIG. 9 illustrate a close up of an end-cap with grooves to aid wicking and ridges to trap liquid.

The grooves may form a symmetrical pattern around the fluid exit 6, as seen on FIGS. 7, 9.

The grooves may be found in a single continuous area of the front face of the end cap. Alternative there may two or more distinct groupings of grooves on the end cap.

To aid the efficacy of the grooves it is also preferable modify the surface of the end cap to encourage maximum wetting. This may be achieved by selecting a more hydrophilic material for the end cap.

Figure 8:
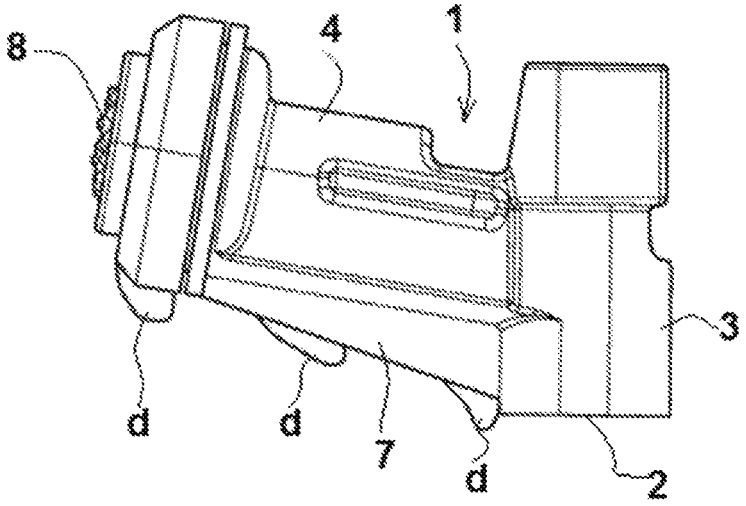
FIG. 8 illustrates the wicking effect of the droplet rib.

As seen on FIG. 8, the end cap 5 may also comprise ridges 9 on its outer surface to retain moisture. Preferably these ridges 9 comprise raised portions of the surface of the end cap that prevent small droplets from moving across the surface.

As seen on FIG. 9, the ridges 9 differ from the grooves 8 in that they raised from the surface and act as a barrier not a wicking or transport function.

There may be a single ridge, or there may be multiple ridges. Preferably there are two or three ridges.

The ridges 9 may be between 0.1 and 5 mm above the surface of the end cap.

These may also be symmetrically arranged around outlet 6. Alternatively these may only be found below the outlet 6.

As seen on FIG. 9, preferably the ridges 9 are outside at least a portion of the grooves 8. By outside, it is meant that the ridges are further from the outlet 6 than at least a portion of the grooves.

The outlet heads of the present invention may be used with any aerosol formulations. The outlet heads are particularly useful with an automatic aerosol spray device.

The outlet or spray heads of the present invention may only be suitable for use with an aerosol formulation.

A particularly preferred use of the outlet heads of the present invention is as an actuator designed for use with compressed air aerosol formulations.

The invention claimed is:

1. An outlet head comprising:

an inlet section having an opening adapted to receive an output section of a pressurized spray material container, said opening forming a first end of a fluid channel for receiving a spray material from the spray material container;

an outlet section including an end-cap adapted to eject the spray material and forming a second end of the fluid channel for ejecting the spray material into air, wherein the outlet section is angled between 5 and 45 degrees above the horizontal plane, and further wherein the outlet section is angled to eject the spray material between 5 and 45 above the horizontal plane; and a droplet rib positioned directly below, depends from the outlet section and is on the exterior thereof, the droplet rib extending from the end-cap towards the first end of the fluid channel; such that droplets forming on the end cap are drawn down the droplet rib and towards the first end of the fluid channel, wherein the droplets run onto but not into the spray material container.

2. The outlet head of claim 1 wherein the outlet section is angled between 5 and 25 degrees above the horizontal plane.

3. The outlet head of claim 1 wherein the outlet section is angled between 7 and 15 degrees above the horizontal plane.

4. The outlet head of claim 1 wherein the outlet section is angled between 9 and 12 degrees above the horizontal plane.

5. The outlet head of claim 1 wherein a front face of the end-cap is planar perpendicular to the second end of the fluid channel and wherein the second end of the fluid channel is located at the centre of the front face.

6. The outlet head of claim 5 wherein the front face of the end-cap is convex in profile and wherein the second end of the fluid channel is located at the most raised section of the end-cap.

7. The outlet head of claim 1 wherein the end-cap comprises grooves in its surface adjacent the second end of the fluid channel, wherein the grooves provide a wicking effect to liquids remaining on the end cap.

8. The outlet head of claim 7 wherein the grooves form a symmetric pattern around the second end of the fluid channel.

9. The outlet head of claim 1 wherein the end cap further comprises ridges that may slow or trap liquid droplets building up on the end-cap.

10. The outlet head of claim 1 wherein the droplet rib has a constant width along its length.

11. The outlet head of claim 1 wherein the droplet rib further comprises a bottom surface, wherein the droplet rib has an increasing height along its length from the end-cap to the inlet section, such that an angle of its bottom surface relative to the horizontal plane is greater than that of the output section relative to the horizontal plane.

12. The outlet head of claim 11 wherein the angle of the bottom surface of the droplet rib relative to the horizontal plane is between 3 and 25 degrees greater than the outlet section relative to the horizontal plane.

13. A method of dispensing spray material from a pressurized spray material container which spray material is a compressed air aerosol formulation, which method comprises the step of:

providing an outlet head of claim 1 to the pressurized spray material container, and, dispensing the spray material from the pressurized spray material container through the outlet head.

14. An outlet head comprising:

an inlet section having an opening adapted to receive an output section of a pressurized spray material container, said opening forming a first end of a fluid channel for receiving a spray material from the spray material container;

an outlet section including an end-cap adapted to eject the spray material and forming a second end of the fluid channel for ejecting the spray material into air, wherein the outlet section is angled between 95 and 135 degrees relative to the inlet section, and a droplet rib depending from the outlet section, positioned directly below, depends from the outlet section and is on the exterior thereof, the droplet rib extending from the end-cap towards the first end of the fluid channel; such that droplets forming on the end cap are drawn down the droplet rib and towards the first end of the fluid channel, wherein the droplets run onto but not into the spray material container.

15. The outlet head of claim 14 wherein the droplet rib has a constant width along its length.

16. The outlet head of claim 14 wherein the droplet rib further comprises a bottom surface, wherein the droplet rib has an increasing height along its length from the end-cap to the inlet section, such that an angle of its bottom surface relative to the inlet section is greater than that of the output section relative to the inlet section.

* * * * *